US011345490B2

(12) United States Patent
Prakken et al.

(10) Patent No.: US 11,345,490 B2
(45) Date of Patent: May 31, 2022

(54) COMPACTOR DEVICE AND CONVEYER SYSTEM COMPRISING SUCH COMPACTOR DEVICE, AND CORRESPONDING COMPACTING AND PACKING METHODS

(71) Applicant: BLUEPRINT HOLDING B.V., Woerden (NL)

(72) Inventors: Nicolaas Martin Prakken, Chester, VA (US); Vincentius Alphonsus Jozef Peters, Baarn (NL)

(73) Assignee: BLUEPRINT HOLDING B.V., Woerden (NL)

( * ) Notice: Subject to any disclaimer, the term of this patent is extended or adjusted under 35 U.S.C. 154(b) by 231 days.

(21) Appl. No.: 16/758,560

(22) PCT Filed: Oct. 23, 2018

(86) PCT No.: PCT/NL2018/050704
§ 371 (c)(1),
(2) Date: Apr. 23, 2020

(87) PCT Pub. No.: WO2019/083360
PCT Pub. Date: May 2, 2019

(65) Prior Publication Data

US 2020/0346790 A1 Nov. 5, 2020

(30) Foreign Application Priority Data

Oct. 23, 2017 (NL) ..... 2019786

(51) Int. Cl.
*B65B 1/24* (2006.01)
*B65B 1/22* (2006.01)
*B65B 63/02* (2006.01)

(52) U.S. Cl.
CPC ..... *B65B 1/24* (2013.01); *B65B 1/22* (2013.01); *B65B 63/028* (2013.01)

(58) Field of Classification Search
CPC .. B65B 1/22; B65B 1/24; B65B 63/00; B65B 63/028; B65B 63/022; B65B 63/02; B65B 25/046
See application file for complete search history.

(56) References Cited

U.S. PATENT DOCUMENTS 4,864,801 A * 9/1989 Fallas ..... B65B 5/061 53/446
5,284,003 A * 2/1994 Goodman ..... B65B 5/061 198/762

(Continued)

FOREIGN PATENT DOCUMENTS

CN 2866337 Y 2/2007
CN 103112697 A 5/2013

(Continued)

OTHER PUBLICATIONS

International Search Report, PCT/NL2018/050704, dated Jan. 28, 2019.

(Continued)

*Primary Examiner* — Andrew M Tecco
*Assistant Examiner* — Nicholas E Igbokwe
(74) *Attorney, Agent, or Firm* — Nixon & Vanderhye

(57) ABSTRACT

A compactor device for compacting a product filling in a container, like a packing box, includes a container support allowing shaking and/or vibrating the container when supported on the container support. The support includes compactor roller bars arranged parallel in a direction transverse to a conveying direction and to support the container. Each compactor roller bar has a rotation axis and a circumferential surface to allow moving the container with a product filling supported on the rollers bars up and down at a selected frequency when, in operation, rotating the compactor roller bars of the plurality of compactor roller bars. The compactor device further has a stopper arrangement blocking convey- (Continued)

ing the container by the compactor roller bars, and a pressing arrangement with a press to press downwards onto the product filling within the container while, in operation, compacting the product by rotating the compactor roller bars.

26 Claims, 9 Drawing Sheets

(56) References Cited

U.S. PATENT DOCUMENTS

| | | | | |
|---|---|---|---|---|
| 6,668,522 | B2 * | 12/2003 | Prakken | B65B 63/028 53/433 |
| 2008/0192565 | A1 * | 8/2008 | Johnson | B01F 31/201 366/109 |
| 2010/0112273 | A1 * | 5/2010 | Pedoja | D04H 1/43838 428/91 |
| 2016/0251097 | A1 * | 9/2016 | Elias | B65D 77/20 426/106 |

FOREIGN PATENT DOCUMENTS

| | | | |
|---|---|---|---|
| CN | 103350795 | A | 10/2013 |
| CN | 203958752 | U | 11/2014 |
| CN | 104670540 | A | 6/2015 |
| CN | 207292491 | U | 5/2018 |
| GB | 2 305 733 | | 4/1997 |
| GB | 2 209 447 | | 7/1997 |
| GB | 2 309 447 | A | 7/1997 |
| JP | 59 43719 | | 3/1984 |
| JP | S59-43719 | A | 3/1984 |
| WO | WO 2010/052279 | | 5/2010 |
| WO | WO 2010/095957 | | 8/2010 |

OTHER PUBLICATIONS

Written Opinion, PCT/NL2018/050704, dated Jan. 28, 2019.
Chinese Search Report for CN Application No. 2018800692598 dated Jun. 27, 2021, 6 pages.

* cited by examiner

COMPACTOR DEVICE AND CONVEYER SYSTEM COMPRISING SUCH COMPACTOR DEVICE, AND CORRESPONDING COMPACTING AND PACKING METHODS

FIELD OF THE INVENTION

The invention relates to a compactor device for compacting a product filling, like vented bags containing frozen products, in a container, like a packing box, the compactor device comprising a container support configured to allow shaking and/or vibrating the container when supported on the container support.

BACKGROUND OF THE INVENTION

Such compactor devices are known for compacting product fillings in containers such as packing boxes. The product filling can be frozen and loose, yet unfried french fries (generally, initially fried and subsequently frozen, but not yet finally fried) that are bulk-filled into the packing box or are first provided into bags after which multiple of such bags are packed into a single packing box. The loose product can also be frozen vegetables, but is not limited to such kind of products. The bags should be vented to allow air to escape from the bags when compacting, which can be achieved by providing perforations in the bag, but a small opening in a seal in the bag may also be sufficient for the purpose. Both type and also other sorts of product fillings take initially more space than actually required. The product filling will then become more packed while being transported in the packing box to take less volume within the packing box, which is quite inefficient with regard to the available volume of the box. Further, it also negatively effects the stability of the packing box as the product filling contributes to the overall stability of the product-filled packing box. It is therefore required to compact the product filling within the packing box so that the product filling occupies the whole available volume before closing the packing box.

The container support in known compactor devices has a plate-like configuration on which, for instance, the packing box is positioned. The plate-like configuration is subsequently brought into vibration to compact the product filling. However, the load of the packing box with the product filling generally damps the vibration by decreasing its amplitude and frequency, which negatively effects the efficiency of compacting of the product filling. This results in a below optimal compacting and/or a long time period required for compacting the product filling.

Other types of compacter device are known as well. The prior art compacter devices are rather limited in the number of containers that can be processed in a given time frame, whereas high processing rates are in demand. Further, an improved compacting efficiency is required to allow to pack more of a product, especially (vented) bags containing loose products, into a container, together with a straightforward and efficient machine design that is also very beneficial from a point of view of hygiene and maintenance.

US 2008/0192565 A1 discloses an agitation machine having non-circular or eccentric agitation rods arranged with their rotation axis in the travel direction of containers of which the contents are to be settled and compacted. A separate conveyer system is provided to engage the container and push the container over the agitation rods in the travel direction while being agitated. The agitation machine has separate mechanisms for agitation and for conveying, and requires separate drives for driving the agitation rods and the flight bar conveyors. The capacity in terms of number of containers that can be processed per time unit and the compaction of the product filling that can be achieved proves to be quite limited.

GB 2 305 733 A discloses a settling conveyer in a fertilizer production process and apparatus. The settling conveyer has conveying rollers of non-round cross-section to both shake the bags while being transported by the rollers. Again, the capacity in terms of number of containers that can be processed per time unit and the compaction that can be achieved proves to be quite limited.

WO 2010/095957 A1 discloses an apparatus and method for arranging articles in a container by vibrating the container and applying a pressure to the articles in the container. The number of containers that can be handled per minute with such machine is rather limited and incorporation into a conveying and packaging line would prove troublesome.

WO 2010/052279 discloses a process and apparatus for packaging potato crisps, which employ a conveyer for transporting a box with the crisps and some means for shaking/vibrating the container with the crisps. In a final step when lids of the box have been closed a slight pressure may be exerted for some final compaction. They are not suited to obtain a high capacity of boxes processed and a large compaction of the product filling.

SUMMARY OF THE INVENTION

The invention intends to overcome limitations of know compactor devices. It is an object or alternative object of the invention to provide a compactor device that provides an improved compacting efficiency. It is yet another or alternative object of the invention to provide a compactor device of which a compacting frequency is not affected by the load on the compactor device. It is yet another or alternative object of the invention to provide a compactor device of which a compacting amplitude is not affected by the load on the compactor device. It is yet another or alternative object of the invention to provide a compactor device that can achieve a high capacity of number of containers processed per time unit.

In an aspect the invention provides for a compactor device for compacting a product filling, like vented bags containing loose products, in a container, like a packing box, the compactor device comprising a container support configured to allow shaking and/or vibrating the container when supported on the container support, wherein the container support comprises

- a plurality of compactor roller bars arranged to support the container, each compactor roller bar having a rotation axis and a circumferential surface along the rotation axis to allow moving the container with a product filling supported on the plurality of compactor rollers bars up and down at a selected frequency when, in operation, rotating the compactor roller bars of the plurality of compactor roller bars, wherein the compactor roller bars of the plurality of compactor roller bars are arranged parallel to one another in a direction transverse to a conveying direction of the container from a supply end to a discharge end of the compactor device to allow conveying the container in the conveying direction on the compactor device;
- a stopper arrangement configured and arranged to block conveying the container by the compactor roller bars of the plurality of compactor roller bars while, in operation, compacting the product filling by rotating the compactor roller bars of the plurality of compactor roller bars; and a pressing arrangement with a pressing element configured and arranged to press downwards directly onto the product filling within the container supported on the plurality of compactor roller bars while, in operation, compacting the product filling by rotating the compactor roller bars of the plurality of compactor roller bars.

Such a compactor device additionally has the advantages that any pollution and/or product filling from the container does not accumulate on the container support, but drops downwards through the open spaces in between the compactor roller bars. As a further advantage, the compactor roller bars can also be employed as transporting rollers for conveying the container through the compactor device. The compactor roller bars can transport the containers at high speed towards and against the stopper arrangement. The device can be designed easily to process more than one container with product filling at the same time. Only the number of compacting rollers and the number of pressing elements need to be increased to match the number of containers to be processed at the same time. A first container will be stopped by the stopper arrangement, while a next container will be stopped by the first container, and so on. The container(s) will come very quickly into alignment with the pressing element(s), which can be lowered with relatively high speed towards and onto the product filling. The device could be operated in batched of containers or in a more continuous mode when processing multiple containers at the same time. In the more continuous mode when processing multiple containers with product filling, a container can each tome be advanced to a next pressing element for further compaction until final compaction is reached at the last pressing element. The compacting roller bars are about the dimension of the container transverse to the conveying direction, and will thus be vert rigid to be able to withstand large compaction forces. It has been shown that in the order of 25 boxes per minute can be processed when having a product filling of seven vented bags of frozen French fries, which is a very high capacity that cannot be reached by any prior art device.

In an embodiment the compactor device further comprises confining walls configured and arranged to confine opposing sides of the container while, in operation, compacting the product filling by rotating the compactor roller bars of the plurality of compactor roller bars and pressing onto the product filling by the pressing arrangement. The confining walls counteract an internal pressure acting on the container walls during a compacting operation so that damage of the container is prevented and even an even higher capacity and larger compaction can be achieved.

In an embodiment the confining walls comprise opposing guiding walls arranged along the conveying direction to guide the container there between when being conveyed over the compactor device. It proves advantageous in terms of machine design efficiency and handling time per container to employ the same elements for guiding and confinement.

In an embodiment the stopper arrangement comprises at least one stopper door that can be positioned in front of the container as seen in the conveying direction, which provides an efficient and very reliable means to block the containers and to provide alignment of containers and pressing elements.

In an embodiment the circumferential surface of each compactor roller bar presents line symmetry with respect to the rotation axis and an equal cross-sectional shape, perpendicular to the rotation axis, with equal dimensions along the rotation axis, which cross-sectional shape is different from a circular shape.

In an embodiment the compactor device is configured to directly support the container on the plurality of compactor roller bars.

In an embodiment the pressing arrangement is configured to provide a predetermined downward force by the pressing element onto the product filling in the container while, in operation, compacting the product filling by rotating the compactor roller bars of the plurality of compactor roller bars and pressing onto the product filling by the pressing arrangement.

In an embodiment the pressing element is configured as a mass and the pressing arrangement is configured to have a weight of the mass fully supported by the product filling in the container while, in operation, compacting the product filling by rotating the compactor roller bars of the plurality of compactor roller bars and pressing onto the product filling by the pressing arrangement.

In an embodiment the pressing arrangement comprises an actuator arranged to allow moving the pressing element up and down, optionally the actuator being a servo drive, which can prove very advantageous in a very fast positioning of the pressing element on top of the product filling, especially when an initial height of the product filling can be determined.

In an embodiment the pressing arrangement comprises more than one pressing element arranged along the conveying direction for compacting product fillings in respective consecutive containers, which even further enhances capacity and compaction.

In an embodiment each pressing element is coupled to a respective actuator, optionally each actuator being a servo drive, to allow moving the pressing elements up and down independently from one another so that each pressing element can set to approach an initial height of a product filling of an associated container very rapidly.

In an embodiment the compactor roller bars of the plurality of compactor roller bars are configured to each present a same circumferential surface with an equal cross-sectional shape, perpendicular to the rotation axis, with equal dimensions along their respective rotation axes, which proves to provide efficient compacting of the product filling.

In an embodiment the compactor roller bars of the plurality of compactor roller bars are arranged to provide synchronous rotation. In synchronous rotation the cross-sectional shapes of the individual compactor roller bars are oriented the same and the individual compactor roller bars are driven at the same rotational speed, which further proves to provide efficient compacting of the product filling.

In an embodiment the circumferential surface is a smooth continuous surface, which is advantageous with respect to preventing damage to the containers with the product filling. A smooth continuous should be understood to be a surface without sudden and or sharp transitions between surface sections.

In an embodiment the circumferential surface comprises convex rounded surface sections along the rotation axis, which are connected to one another by flat surface sections along the rotation axis, which, inter alia, is readily manufactured and can provide a smooth continuous surface. The container is lifted by the convex rounded surface sections, looses for a moment contact with the compactor roller bar at the end of the convex rounded surface section at sufficient rotational speed, and subsequently lands on the flat surface sections. Having a sudden drop on the flat surface section provides for a good compacting of the product filling.

In an embodiment the convex rounded surface sections conform to constituting parts of a virtual circular cylinder surface around the rotation axis but are each shifted in an outward direction with respect to the respective part of the virtual circular cylinder surface, which efficiently provides for a smooth continuous surface. The convex rounded surfaces are shifted perpendicular with respect to respective division planes that divide the respective constituting parts of the virtual circular cylinder. The constituting parts together fully form the virtual circular cylinder. The compactor roller bars can readily be manufactured by taking a circular cylindrical pipe and actually dividing the pipe along the division planes and welding flat sections in between, or by appropriately rolling the pipe.

In an embodiment the circumferential surface comprises two or four convex rounded surface sections, optionally each convex rounded surface section corresponding to a half part or a quarter part, respectively, of the virtual circular cylinder surface. Having two or four convex rounded surface sections proves to be advantageous in operating the compactor roller bar. By having the convex rounded surface sections shifted by an equal amount perpendicular to the division planes one dominant vibration frequency is selected.

In an embodiment the circumferential surface comprises two convex rounded surface sections, each convex rounded surface section corresponding to a half part of the virtual circular cylinder surface having a diameter between 20 mm and 50 mm, optionally between 25 mm and 40 mm, optionally between 30 mm and 35 mm, and a cross-sectional width to cross-sectional thickness ratio being between 1.2 and 2, and the compactor device is configured to drive the compactor roller bars at a rotational speed between 200 rpm and 1,000 rpm, optionally between 400 rpm and 700 rpm. Such dimensions and rotational speeds haven proven to provide large compaction and low handling time per container.

In an alternative embodiment a cross-sectional shape, perpendicular to the rotation axis, of the circumferential surface presents an oval shape, optionally an elliptical shape, which also proves to provide an efficient manufacture, implementation and operation of the compactor device.

In an embodiment the compactor device comprises a frame in which the plurality of compactor roller bars are mounted, which forms, in operation when compacting a product filling in a container by rotating the compactor roller bars of the plurality of compactor roller bars, a primary mass-spring system, and the compactor device comprises a damper mass mounted on the frame by mounting elements having spring characteristics such as to form a secondary mass-spring system. A configuration with a damper mass proves to be very efficient in reducing vibrations of the compactor device, and prevents damage caused by such vibrations and movement of the compactor device.

In an embodiment the secondary mass-spring system is tuned to the primary mass-spring system such as to allow energy transfer from the primary mass-spring system to the secondary mass-spring system, which provides for a very efficient reduction of vibrations.

In an embodiment the damper mass is mounted below the plurality of compactor roller bars in a central position with respect to a length of the compactor roller bars of the plurality of compactor roller bars as seen in a longitudinal direction of each compactor roller bar and a length of the plurality of compactor roller bars as seen in a direction perpendicular to the longitudinal direction of each compactor roller bar, optionally the damper mass having a length corresponding to the length of the plurality of compactor roller bars. Such configurations show to be both advantageously to manufacture and to present an advantageous vibration damping.

In an embodiment the compactor device comprises at least one gripping roller bar, optionally having a circular cylindrical shape, arranged parallel to the compactor roller bars of the plurality of compactor roller bars and positioned at a discharge end of the plurality of compactor roller bars, which gripping roller bar(s) is/are configured and arranged such as to allow discharge of the container from the compactor device by, in operation, rotating in a same rotation direction as but at a higher rotational speed than the compactor roller bars of the plurality of compactor roller bars. Having one or more gripping roller bars provides an advantageous discharge and handling control of the containers.

In an embodiment rotation axes of adjacent roller bars are coupled to one another through a belt and gear system, and a rotation axis is driven by a motor. Only one motor is required to drive all roller bars and the belt and gear system proves to be very reliable in keeping a mutual rotational position of the rollers.

In an embodiment a compacting to gripping roller bar transmission ratio of the belt and gear system between adjacent compactor and gripping roller bars is larger, optionally a compacting to gripping roller bar transmission ratio between 1.5 and 3, optionally 2, than a transmission ratio equal to 1 of a belt and gear system between adjacent compactor roller bars and between adjacent gripping roller bars, such that, in operation, the gripping roller bar(s) rotate(s) at a higher speed than the compactor roller bars. Such transmission ratio proves to be advantageous in a fast discharge of a container with compacted product filling and providing sufficient time to set the stopper arrangement for blocking the next container.

In another aspect the invention provides for a conveyer system comprising a compactor device as referred to above.

In another aspect the invention provides for a compacting method for compacting a product filling in a container, the method comprising

- providing at least one container having a product filling comprising loose products, like vented bags containing loose products, and with its top side open onto a compactor device or a conveyor system as referred to above;
- compacting the product filling by operating the compacting device, the pressing element of the pressing arrangement acting on the product filling through the open top side of the container; and
- discharging the container with a compacted product filling from the compactor device or the conveyor system.

In another aspect the invention provides for a packing method for packing a product filling in a container, the method comprising

- providing a product filling comprising loose products, like vented bags containing loose products, into at least one container, optionally a packing box;
- providing the at least one container having a product filling and with its top side open onto a compactor device or a conveyor system as referred to above;
- compacting the product filling by operating the compacting device, the pressing element of the pressing arrangement acting on the product filling through the open top side of the container;

discharging the container with a compacted product filling from the compactor device or the conveyor system; and closing the top side of the at least one container.

In an embodiment the step of providing a product filling into at least one container comprises providing loose products in vented enclosures, optionally vented bags, and subsequently providing more than one vented bag in a single container.

BRIEF DESCRIPTION OF THE DRAWINGS

Further features and advantages of the invention will become apparent from the description of the invention by way of non-limiting and non-exclusive embodiments. These embodiments are not to be construed as limiting the scope of protection. The person skilled in the art will realize that other alternatives and equivalent embodiments of the invention can be conceived and reduced to practice without departing from the scope of the present invention. Embodiments of the invention will be described with reference to the accompanying drawings, in which like or same reference symbols denote like, same or corresponding parts, and in which.

DETAILED DESCRIPTION OF EMBODIMENTS

Figure 1:
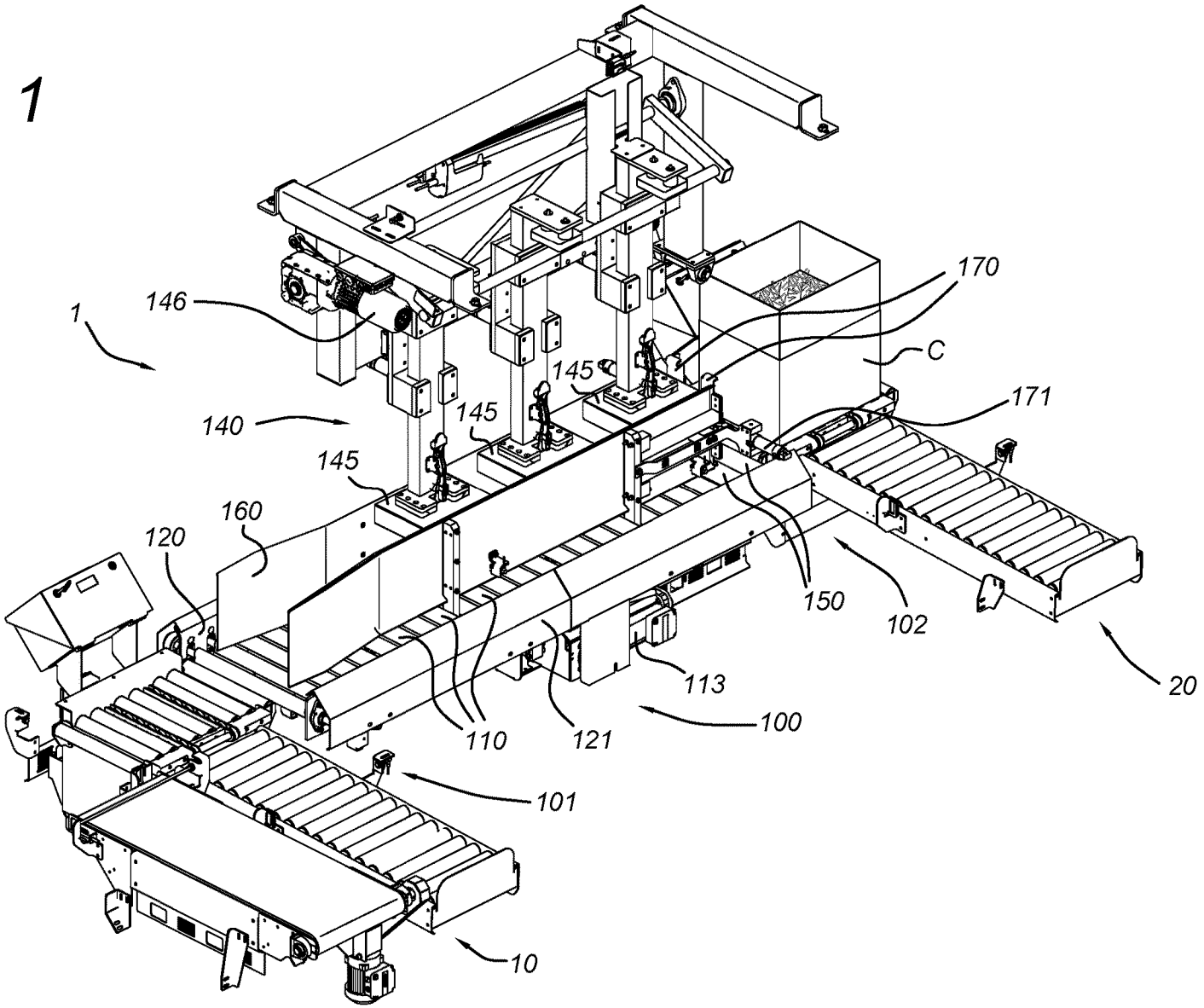
FIG. 1 shows a conveyer system with a compactor device according to the invention.
Figure 2A:
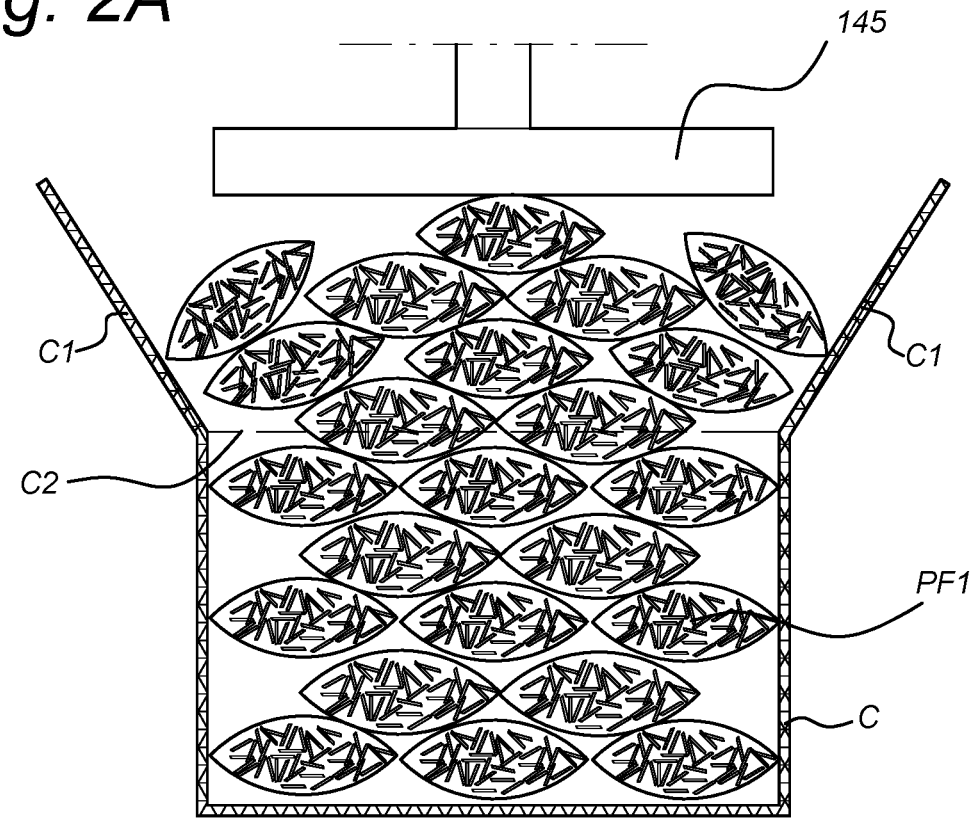
FIGS. 2A and 2B, and FIGS. 2C and 2D schematically show packing boxes with uncompacted and compacted product filling, respectively.
Figure 2B:
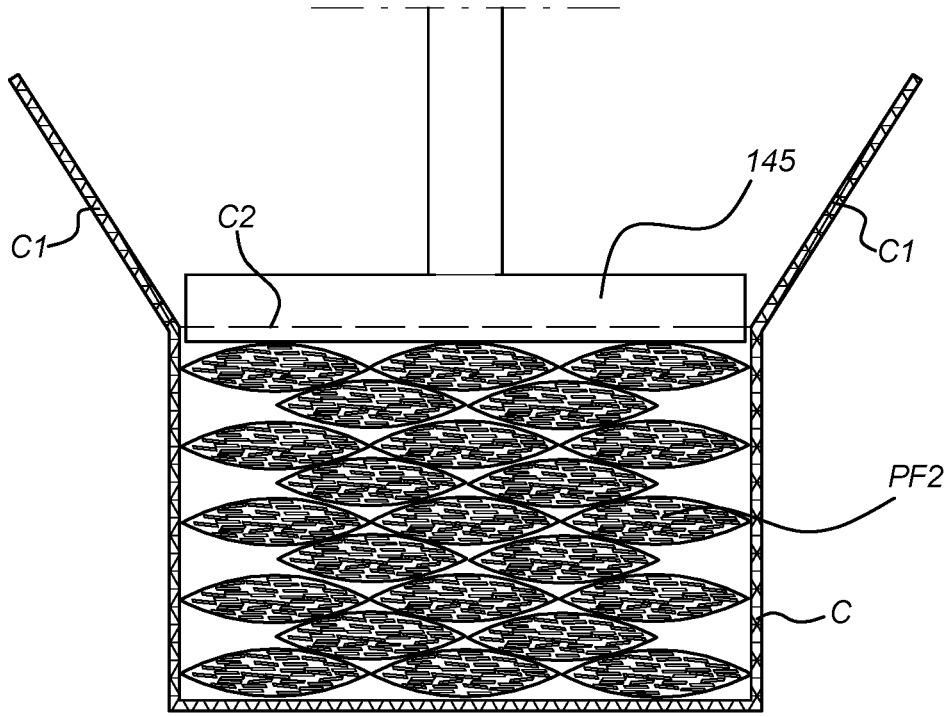
Figure 2C:
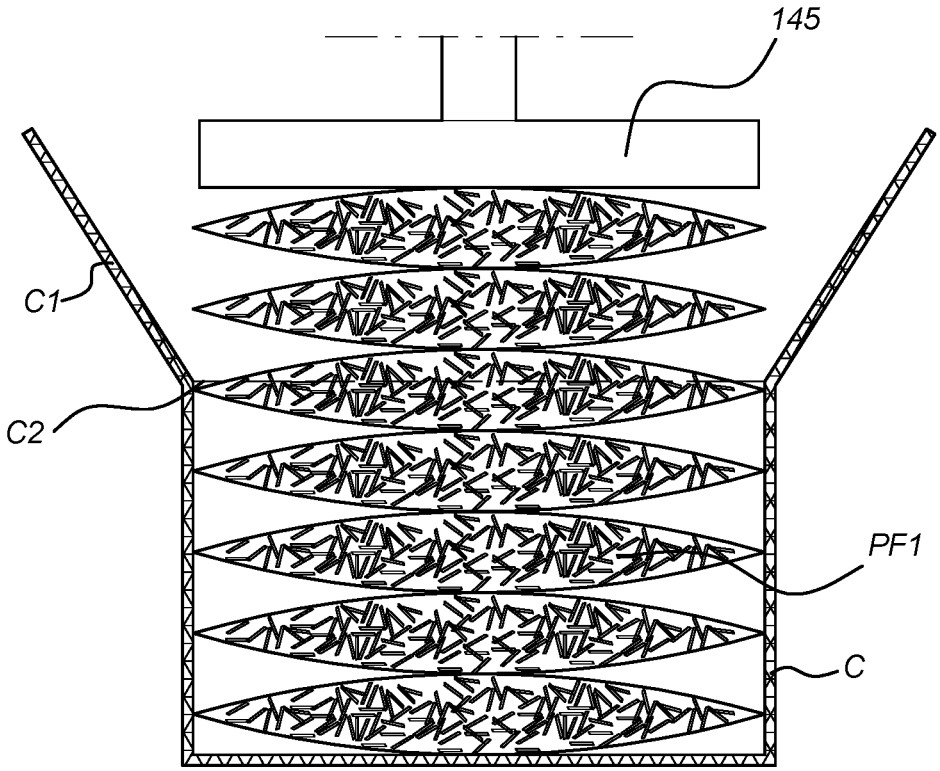
Figure 2D:
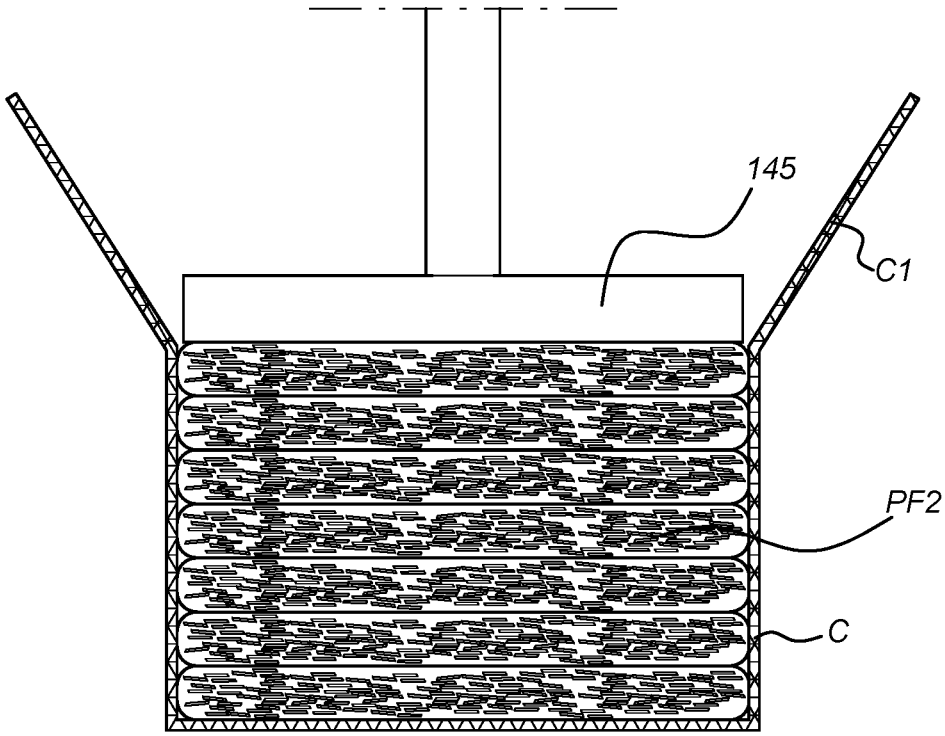

FIG. 1 shows a conveyer system 1 having a compactor device 100 according to the invention, a supply conveyer track 10 for providing containers, which are packing boxes in the embodiment shown, with an uncompacted product filling to a supply end 101 of the compactor device 100, and a discharge conveyer track 20 for moving away packing boxes C with a compacted product filling from a discharge end 102 of the compactor device. The figure only shows a packing box C near the discharge end of the packing device 100 for illustration purposes. Generally, in operation, a flow of packing boxes with a product filling will pass over the conveyer system with multiple packing boxes on the supply conveyer track 10, multiple packing boxes in the compactor device 100 and multiple boxes on the discharge conveyer track 20, although a single packing box with a product filling may also be processed by the conveyer system, or a compactor device. The conveyer system with the compactor device is shown with a packing box of which a product filling is compacted. Generally, any container with a product filling may be processed by the conveyer system and, more specifically, with the compactor device according to the invention. The layout of the conveyer system and the compactor device is to be adapted to the containers to be processed.

FIGS. 2A and 2B, and FIGS. 2C and 2D schematically show a packing box with an uncompacted product filling PF1 and a compacted product filling PF2, respectively. In the example shown, the product filling PF consists of unbaked French fries that have been provided in a number of perforated bags. Air is also included into the bags while providing the French fries into the bags. In the compacting process with the compactor device, the air is forced out of the perforated bags and the French fries become more aligned parallel with the bottom of the packing box. As a result the product filling PF2 of bags with unbaked French fries occupies less volume in the compacted condition as compared to the uncompacted condition, and a very efficient filling of the packing box is achieved. Actually, the whole volume of the packing box is filled, with no overfilling of the packing box. Below, reference will be made to a packing box as the container for the product filling, but it should be understood that any container with a product filling can be compacted using the compactor device according to the invention. FIGS. 2A, 2B, 2C and 2D also show a pressing element 145 of a pressing arrangement of the compactor device to assist in compacting the product filling to a level of a top edge C2 of the packing box C so that flaps C1 of the packing box can be folded and closed over the product filling. Compacting the product filling allows a much larger amount of product to be filled in the packing box and a much more stable packing box with product filling for handling, transportation and storage purposes. Before compacting the height of the uncompacted product filling PF1 can be around 150% of the height of the compacted product filling PF2, but this will be depended on the actual containers and product filling used. A very large reduction in volume occupied by the product filling can be achieved.

Figure 3:
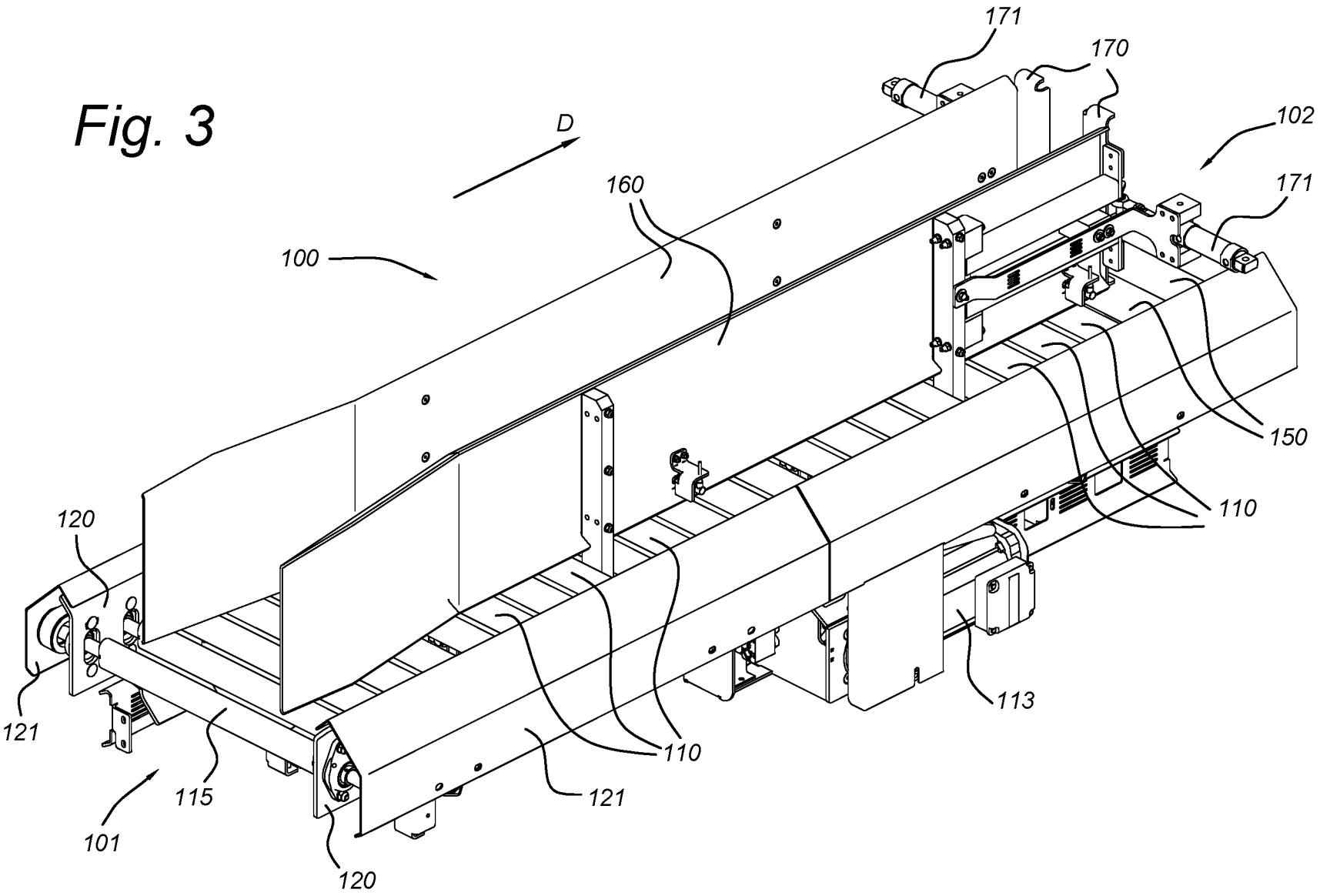
FIG. 3 shows the compactor device of FIG. 1, but with an upper part removed.
Figure 4:
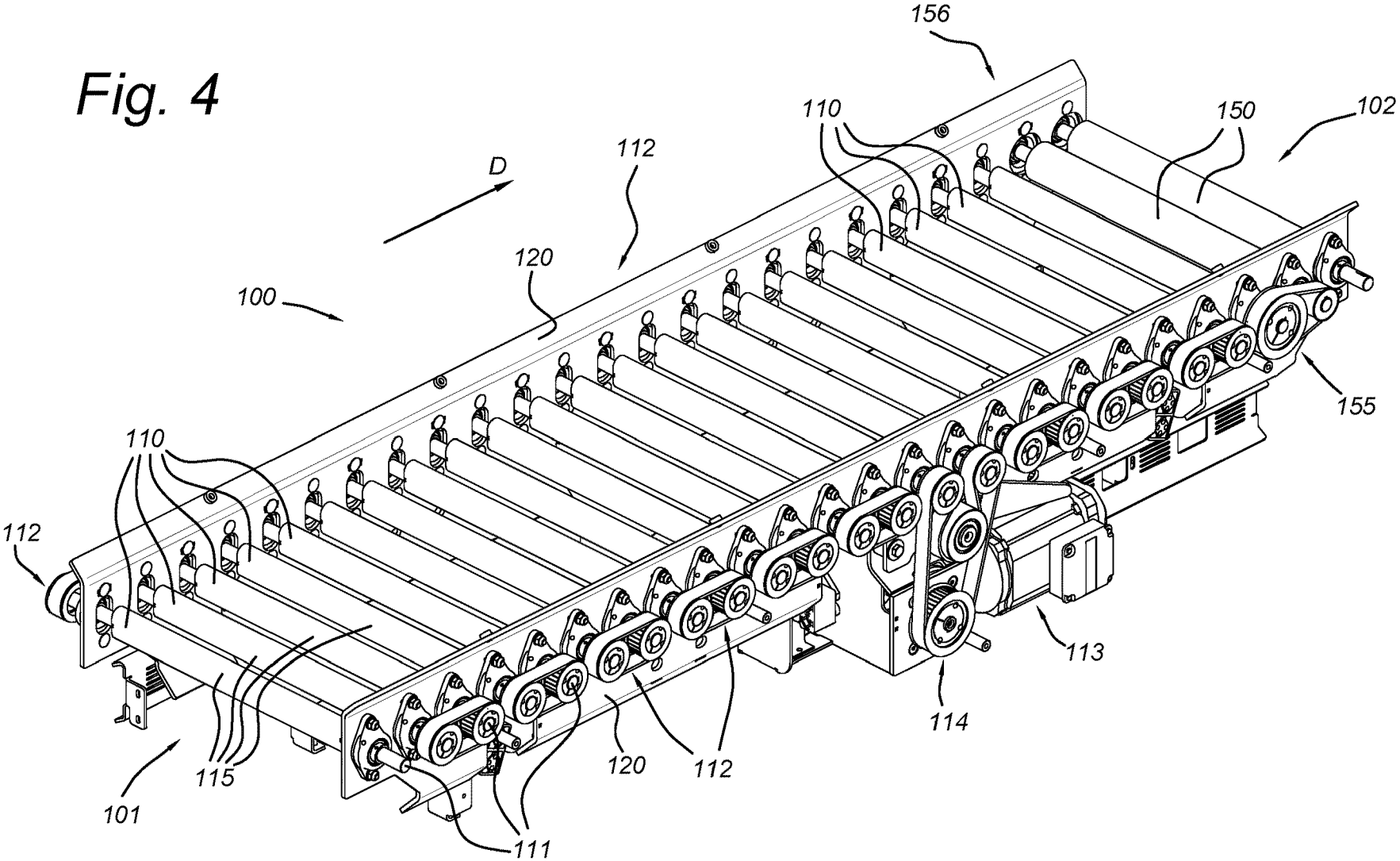
FIG. 4 shows the compactor device of FIGS. 1 and 3, but with some additional parts removed to show more detail.

FIG. 3 shows the compactor device of FIG. 1 in more detail, although the pressing arrangement 140 is not shown in FIG. 3, which is shown in FIG. 1. FIG. 4 shows even more details of the compactor device 100 as some parts of the compactor device as shown in FIG. 4 are taken away with respect to FIG. 3. Protective skirts 121, guiding walls 160 and stopper doors 170 are not shown in FIG. 4, which are present in FIG. 3. The compactor device comprises a plurality of compactor roller bars 110 as a container support for supporting the packing box(es) with the product filling. Each compactor roller bar 110 has a rotation axis 111 that is mounted on a frame 120 to allow rotation of the compactor roller bar. The compactor roller bars are arranged parallel to one another in a direction transverse to the conveying direction D of the containers from the supply end 101 to the discharge end 102 of the compactor device to allow conveying the containers in the conveying direction D on the compactor device. The rotation axes 111 of the compactor roller bars 110 are coupled to one another through belt and gear systems 112 and to a motor 113, also using a belt and gear system, to allow synchronously rotating the compactor roller bars of the plurality of roller bars. The belt and gear systems 112 are provided alternatingly between adjacent compactor roller bars 110 on both sides of the compactor device.

Each compactor roller bar 110 has a circumferential surface 115 along its rotation axis 111, which is shown in more detail in FIGS. 4A and 4B. The circumferential surface presents line symmetry with respect to the rotation axis 111, meaning that both distances from the rotation axis along a straight line perpendicular to and crossing the rotation axis to the circumferential surface on either side of the rotation axis are equal. The cross-sectional shape, perpendicular to the rotation axis, of the compactor roller bars thus presents line symmetry with respect to the rotation axis. The cross-sectional shape of the circumferential surface remains equal with equal dimensions along the rotation axis but is different from a circular shape. The cross-sectional shape of the circumferential surface of the roller bars of the embodiment disclosed with respect to FIGS. 1, 3, 4 and, most specifically, 5A and 5B shows four surface sections 115*a*, 115*b*. Two of these surface sections are convex rounded surface sections 115*a* and the other two surface sections are flat surface sections 115*b*. Each flat surface section is in between and connects the convex rounded surface sections, and thus each convex rounded surface section is in between and connects the flat surface sections.

Figure 5A:
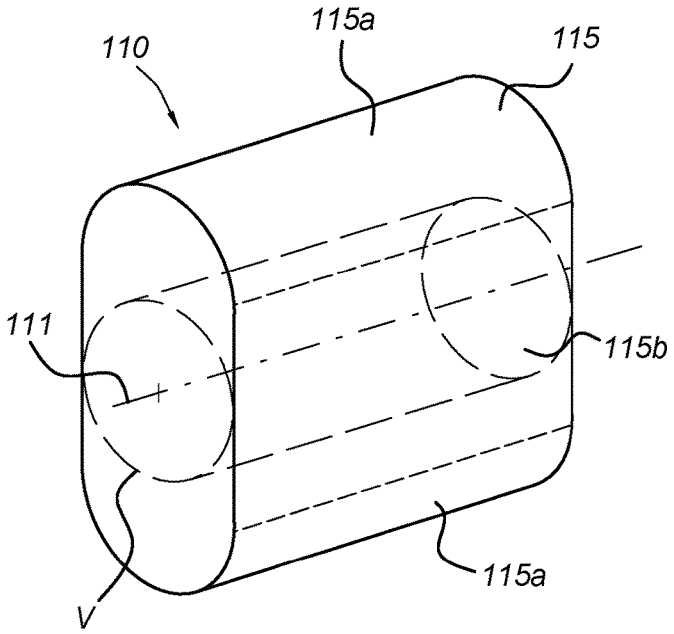
FIGS. 5A and 5B schematically show a compactor roller bar of the compactor device of FIG. 1 in perspective view and cross-section, respectively.
Figure 5B:
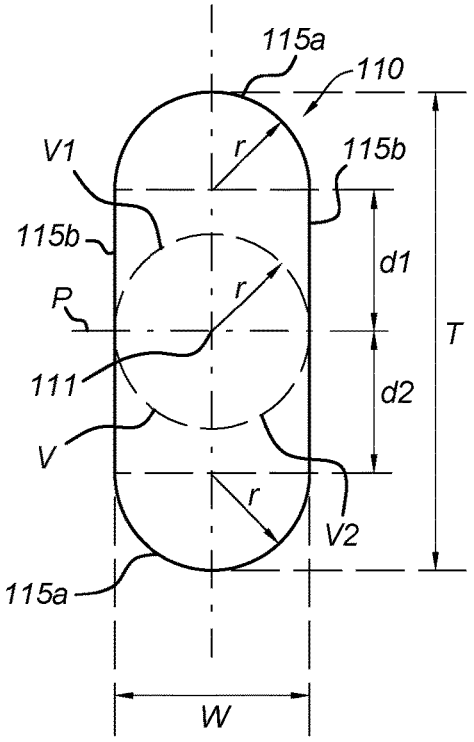

FIG. 5A shows a compactor roller bar of FIGS. 1, 2 and 3 in perspective view and FIG. 5B shows a cross-section perpendicular to the rotation axis 111 of the compactor roller bar. FIGS. 5A and 5B show a virtual circular cylindrical surface V and two convex rounded surface sections 115*a* that conform to respective parts V1, V2 of the virtual circular cylindrical surface. Each convex rounded part is shifted in an outward direction with respect to the respective part of the virtual circular cylindrical surface. The respective parts V1, V2 are constituting parts of the virtual circular cylindrical surface, meaning that they together fully form the virtual circular cylindrical surface V. The convex rounded parts 115*a* show to have the same curvature radius r as the curvature radius of the virtual circular cylindrical surface V and are shifted outwards over respective distances d1 and d2, which are equal in the embodiment shown, perpendicular with respect to a division plane P dividing the circular cylindrical surface V in the parts V1 and V2. The convex rounded surface sections 115*a* are connected by flat surface sections 115*b*.

The parts V1 and V2 are each a half of the circular cylindrical surface V in the embodiment shown. Generally, the distances d1 and d2 need not be identical, and the parts V1 and V2 need not be a half of the circular cylindrical surface. When the one part would be taken smaller than a half, the other part would be larger than a half to still form constituting parts of the circular cylindrical surface V. In all such configurations the circumferential surface 115 of the compactor roller bar 110 would be a smooth continuous surface, meaning that no sudden or sharp transitions are present between surface sections.

Figure 5C:
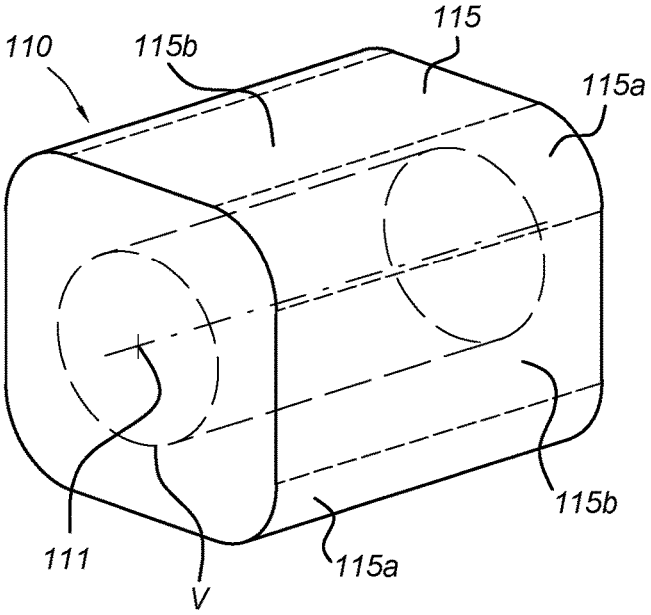
FIGS. 5C and 5D schematically show an alternative compactor roller bar according to the invention in perspective view and cross-section, respectively.
Figure 5D:
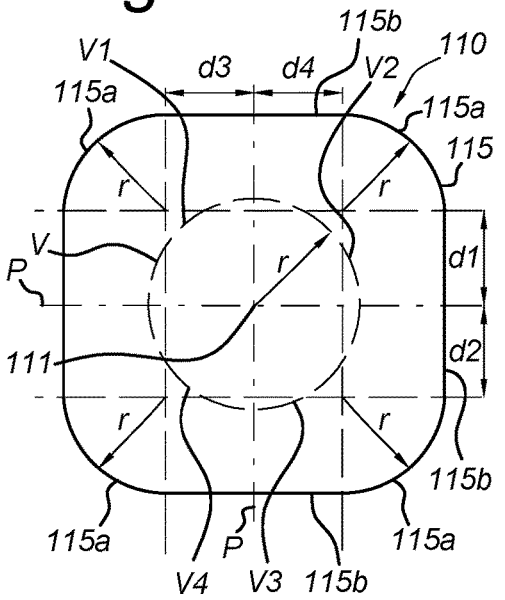

FIGS. 5C and 5D show an alternative embodiment of a compactor roller bar, which has four convex rounded surface sections 115*a* that conform to constituting parts V1, V2, V3, V4 of a virtual circular cylinder surface V around the rotation axis 111 but are each shifted in an outward direction with respect to the respective part of the virtual circular cylinder surface V. In the embodiment of FIGS. 5C and 5D each convex rounded surface section corresponds to a quarter part of the virtual circular cylinder surface V. The convex rounded surface sections 115*a* are connected by flat surface sections 115*b*. The distances d1, d2, d3, d4 over which the convex rounded surface sections 115*a* are shifted perpendicular with respect to the division planes P of the virtual circular cylindrical surface are equal in the embodiment shown. Again, the distances d1, d2, d3 and d4 need not be identical and the constituting parts V1, V2, V3 and V3 need not be a quarter of the circular cylindrical surface. Some may be smaller than a quarter, while other are larger than a quarter. In all such configurations the circumferential surface 115 of the compactor roller bar 110 would be a smooth continuous surface. The configurations shown in FIGS. 5A, 5B, 5C and 5D do present one dominant movement frequency to the packing box at a constant rotational speed of the compactor roller bar.

Figure 6A:
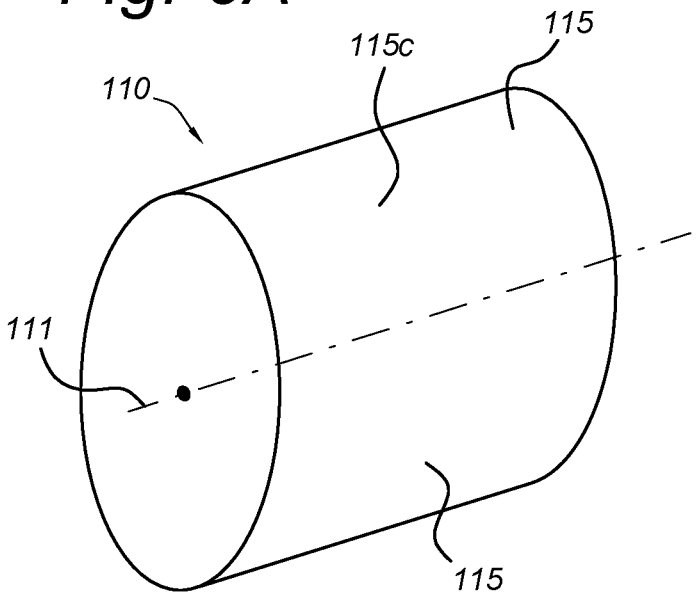
FIGS. 6A and 6B schematically show an alternative embodiment of a compactor roller bar according to the invention in perspective view and cross-section, respectively.
Figure 6B:
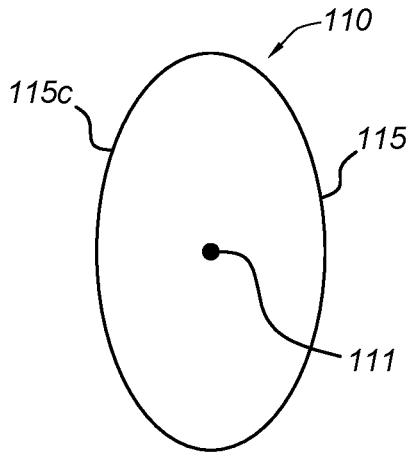
Figure 7:
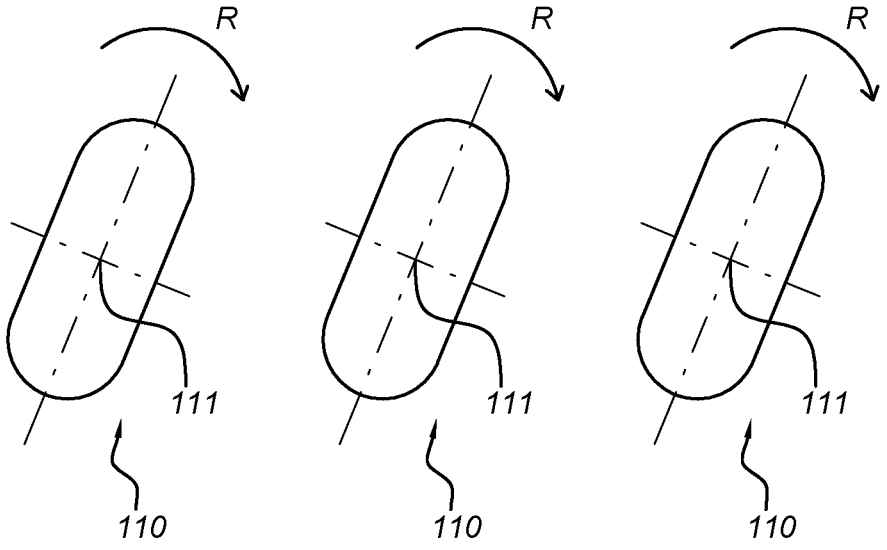
FIG. 7 schematically shows a synchronous arrangement of the compactor roller bars of FIG. 1.

Generally, the circumferential surface of the compactor roller bars can take various shapes. It preferably presents convex rounded surface sections to minimize risks of damaging the packing boxes. The convex rounded surface sections may all conform to part of a same virtual circular cylinder surface around the rotation axis. More than two convex rounded surface sections may be present, for instance four, and the convex rounded surfaces can be separated by flat surface sections. FIGS. 6A and 6B show another embodiment of a circumferential surface 115, of which a cross-sectional shape, perpendicular to the rotation axis, is an oval shape 115*c*, more specifically an elliptical shape in the embodiment shown. The compactor roller bars 110 each have a same circumferential surface 115 with an equal cross-sectional shape, perpendicular to the rotation axis, with equal dimensions along their respective rotation axes 111. It has been described earlier that the compactor roller bars are arranged and coupled to one another to provide synchronous rotation. This means that the compactor roller bars are arranged such that their cross-sectional shapes are oriented the same and that they are driven at the same rotational speed R, as is schematically shown in FIG. 7.

A packing box with a product filling on the plurality of roller bars 110 that are being synchronously rotated will experience an up and down movement as the packing box will try to remain in contact with the circumferential surface of the compactor roller bars due to gravity and a downward force exerted by the pressing arrangement 140. This will provide a frequency of the up and down movement of the packing box, which is given by the rotational speed of the compactor roller bars and the shape of the compactor roller bars. A rotational speed of the compactor roller bars and resulting frequency is to be set, which provides an optimal compacting and equalizing of the product filling in the packing box.

In an embodiment of the compactor device having the compactor roller bars of FIGS. 5A and 5B, the circumferential surface (115) of the compactor roller bars comprises two convex rounded surface sections (115*a*), each convex rounded surface section corresponding to a half part of the virtual circular cylinder surface (V) having a diameter between 20 mm and 50 mm, optionally between 25 mm and 40 mm, optionally between 30 mm and 35 mm. A cross-sectional width W to cross-sectional thickness T ratio W/T is between 1.2 and 2. Such compactor device is advantageously configured to drive the compactor roller bars at a rotational speed between 200 rpm and 1,000 rpm, optionally between 400 rpm and 700 rpm. Such configuration, dimensions and rotational frequencies proved to provide very good results in terms of compacting and handling time per packing box.

Packing boxes with a yet uncompacted product filling are provided on the supply conveyer track 10 to the compactor device 100 at its supply end 101. The rotational speed of the compactor roller bars 100, that are rotationally driven for compacting the product filling, also act to advance the packing boxes with yet uncompacted product filling to a stopper arrangement having stopper doors 170 driven by actuators 171, while being guided by guiding walls 160 for appropriate alignment of the packing boxes on the compactor device. The compactor roller bars 110 thus also act as transporting roller bars for transporting the packing boxes on the compactor device and the packing boxes are directly supported on the plurality of compactor roller bars. The stopper door 170 acts as a stop for the packing box or row of packing boxes on the plurality of compactor roller bars 110, as the container support, of the compactor device 100.

The compactor roller bars 110 of the compactor device may alternatively be driven at a lower rotational speed than would be optimal for compacting purposes when the packing boxes with yet uncompacted product filling are supplied onto the compactor device at its supply end 101. The compactor roller bars driven at the lower rotational speed act as transporting roller bars to transport the packing box(es), guided by the guiding walls 160, to the stopper door 170. The compactor roller bars will subsequently, after lowering the pressing elements 145 of the pressing arrangement 140 onto the product filling, be driven at the higher rotational speed to provide the optimal movement frequency to the packing box(es) to compact the product filling, which is stopped when the required time period has passed, at which moment the rotational speed of the compactor roller bars may be reduced again for the compactor roller bars to act as transporting roller bars and the stopper door 170 is opened to allow discharge of the packing box(es) from the compactor device at its discharge end 102.

The compactor device 100, referring to FIG. 1, has a pressing arrangement 140 with pressing elements 145 that can each be lowered onto the product filling within a packing box for compacting the product filling together with the rotational movement of the compactor roller bars 110. The compactor device in the embodiment shown has three of such pressing elements 145. Alternative embodiments may have one or two, or more than three pressing elements 145. A downward pressure by a pressing element 145 should not be too high so as not to damage the products of the product filling but high enough to, for instance, assist in pressing air out of product bags filled with a product within the packing boxes. The pressing arrangement 140 provides a predetermined downward force by the pressing elements 145 onto the product filling in the container while in a compacting operation. In the embodiment shown, the pressing element 145 acts as a mass and the pressing arrangement 140 is configured to have a weight of the mass fully supported by the product filling in the container in the compacting operation. The mass of each presser element 145, and thus its weight, can be selected for the specific product filling to be compacted. FIG. 1 shows three pressing elements 145 arranged along the conveying direction D for compacting product fillings in respective consecutive containers. The pressing elements 145 can be jointly moved up and down using an actuator 146. In a downward movement, the pressing elements 145 are moved downwards slowly until a pressing element is supported by the product filling in a packing box. Each of the three packing boxes associated with the respective pressing elements will generally have a different height of its product filling, so each pressing element will be supported by their respective product fillings at different moments in time, which has to be taken into account in the joint downwards movement of the pressing elements by the actuator 146.

Figure 8:
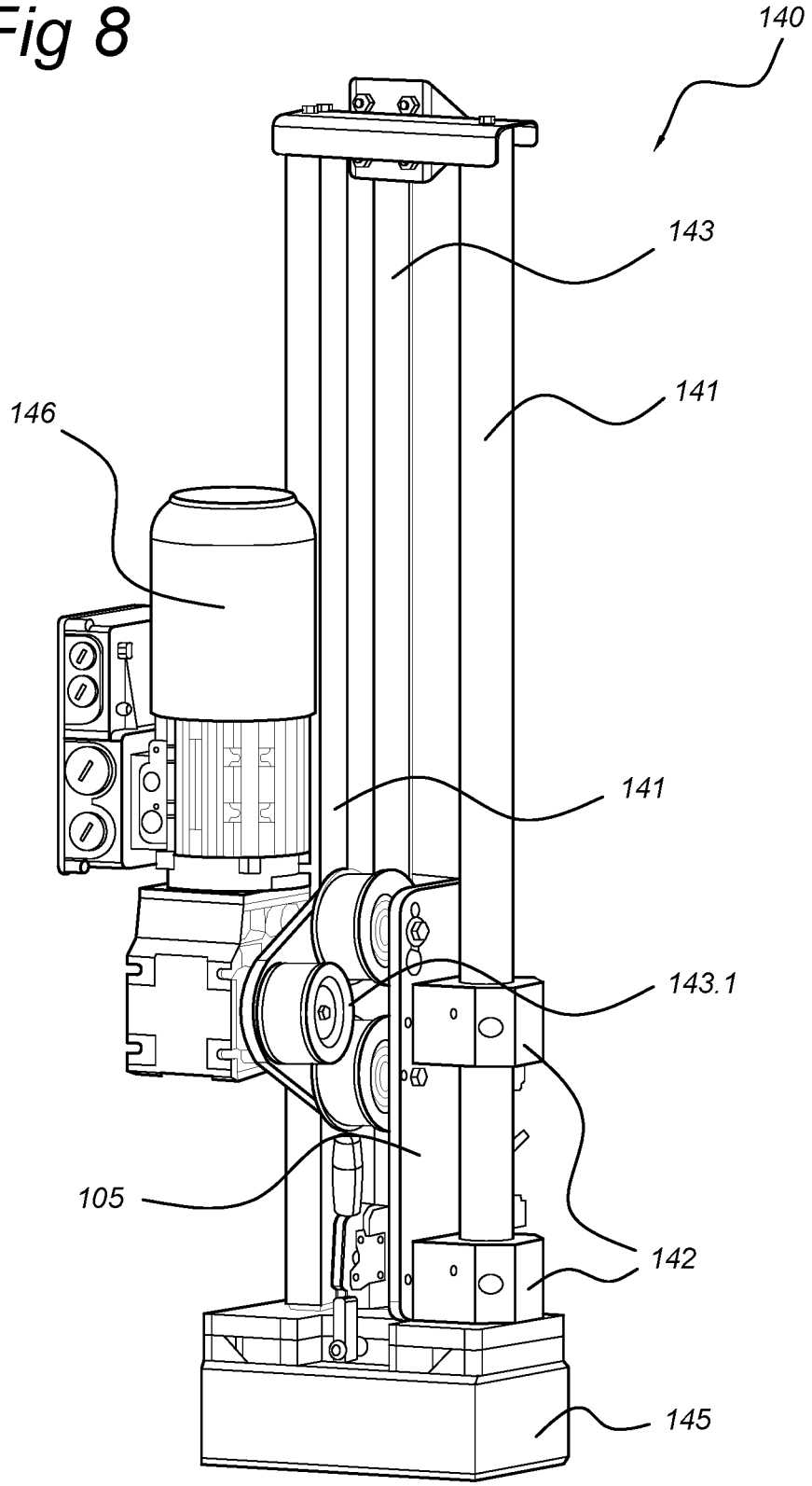
FIG. 8 shows a configuration in another embodiment of a pressing arrangement with a pressing element.

FIG. 8 shows part of an alternative embodiment of a pressing arrangement 140 for moving an individual pressing element 145 up and down. The pressing element 145 is attached to guiding bars or tubes 141 that pass through bearing blocks 142 mounted on a frame part 105 of the frame of the compactor device. The actuator 146 is mounted on the frame of the compactor device as well. The actuator drives a belt 142 through a Ω belt configuration 143.1, the belt 143 being attached to the pressing element 145 and the guiding bars or tubes 141. The assembly of pressing element 145, guiding bars or tubes 141 and belt 143 is thus moved op or down by driving the actuator. Preferably, the actuator is a servo drive for positing the pressing element. After setup of a compactor device for compacting a selected product filling in selected product boxes, an initial height of the product filling before a compacting action will be known and the servo drive can position the pressing element 145 very fast to such position. Subsequently, the servo drive is driven to have the pressing element 145 exert a predetermined vertical force onto the product filling in a compaction action.

The compactor device 100 has two additional gripping roller bars 150 at its discharge end 102, which have a circular cylindrical shape. The gripping roller bars are arranged just behind the stopper doors as seen in de conveying direction D, and are driven at a higher rotational speed than the compactor roller bars 110, which is achieved by the belt and gear system 155 having a higher transmission ratio than the belt and gear systems 112. The compacting to gripping roller bar transmission ratio of the belt and gear system 155 between adjacent compactor and gripping roller bars is larger, optionally a compacting to gripping roller bar transmission ratio being between 1.5 and 3, optionally 2, than the transmission ratio equal to 1 of a belt and gear system 112, 156 between adjacent compactor roller bars 110 and between adjacent gripping roller bars 150. Therefore, in operation, the gripping roller bars rotates at a higher speed than the compactor roller bars. A packing box being gripped by the gripper roller bars will be advanced at a higher speed than a packing box only supported by compactor roller bars 110. A gap will arise between the packing box gripped by the gripping roller bars and the next packing box in line to allow the stopper doors 170 to be closed in the gap between both packing boxes, and to stop the next packing box in line.

In operation of the conveyor system 1 and especially the compactor device 100, packing boxes C with a yet uncompacted product filling are supplied to the supply end 101 of the compactor device. These packing boxes are conveyed up to the stopper arrangement of stopper doors 170, which block further advancement of the packing boxes. A pressing arrangement 140 with three presser elements 145 is shown in FIG. 1, which are used to compact the product filling of the packing boxes in three steps.

A product filling is compacted to a first compacting state by employing the first pressing element encountered by a packing box along the conveying direction, while being blocked by two other packing boxes further down the conveying direction, of which a first one is being blocked by the stopper doors 170. This is achieved by having the first presser element press down onto the product filling while the compactor roller bars 110 are driven in rotation for compacting. The packing box with product filling will experience a vertical movement frequency by the compactor roller bars and a downward pressing force by the pressing element for compacting the product filling, which will be compacted to a required compacting state when a certain time period during which the packing box has experienced the movement frequency has passed.

At the same time, the product filling of the adjacent packing box as seen in the conveying direction D is compacted to a second compacting state, while the product filling of the packing box being blocked by the stopper doors 170 is compacted to a final compacting state. A final compacting state can be recognized, for instance, by monitoring a position of the presser element 145. When the final compacting state of the product filling of that packing box next to the stopper doors has been achieved, the stopper doors 170 are opened to discharge that packing box with compacted product filling from the compactor device 100 at its discharge end 102. The packing box with the product filling compacted to the second compacting state will then be blocked by the stopper doors, and also the packing box with the product filling compacted to the first compacting state will advance a position. A next packing box with a yet uncompacted product filling will be positioned beneath the first pressing element as seen in the conveying direction D, and the cycle as described will be repeated.

The guiding walls 160 for the packing boxes along the conveying direction additionally act as confining walls for the packing boxes with the product filling when being compacted. During a compacting operation a packing box could bulge outward due to the pressing force exerted by the pressing element 145 together with the movement vibration induced by rotation of the compactor roller bars 110. This is prevented by having the packing boxes confined between the guiding walls 160 acting now as confining walls. The packing boxes are arranged on the compactor device with their smaller side panels perpendicular to the conveying direction. This involves that the larger side panels are arranged along the conveying direction and confined by the guiding walls, since these largest side panels are most vulnerable to damage due to bulging out forces. A small clearance in the order of about 0.5 cm is present between the packing boxes and the guiding wall to provide both proper guiding and good confinement. The smaller side panels are less susceptible to bulging out, and will experience some confinement by the stopper doors and preceding and succeeding packing boxes.

Having the pressing arrangement 140 of FIG. 1 replaced by a pressing arrangement with a configuration as shown in FIG. 8 may prove to be more efficient, since pressing elements 145 can be positioned individually and much faster in a required start position. One could dispense with one pressing element 145 as compared to the configuration shown in FIG. 1. However, this may be dependent on the specific requirements for the compactor device. The compactor device can also be employed with a one or two pressing elements or with more than three pressing elements 145.

Figure 9:
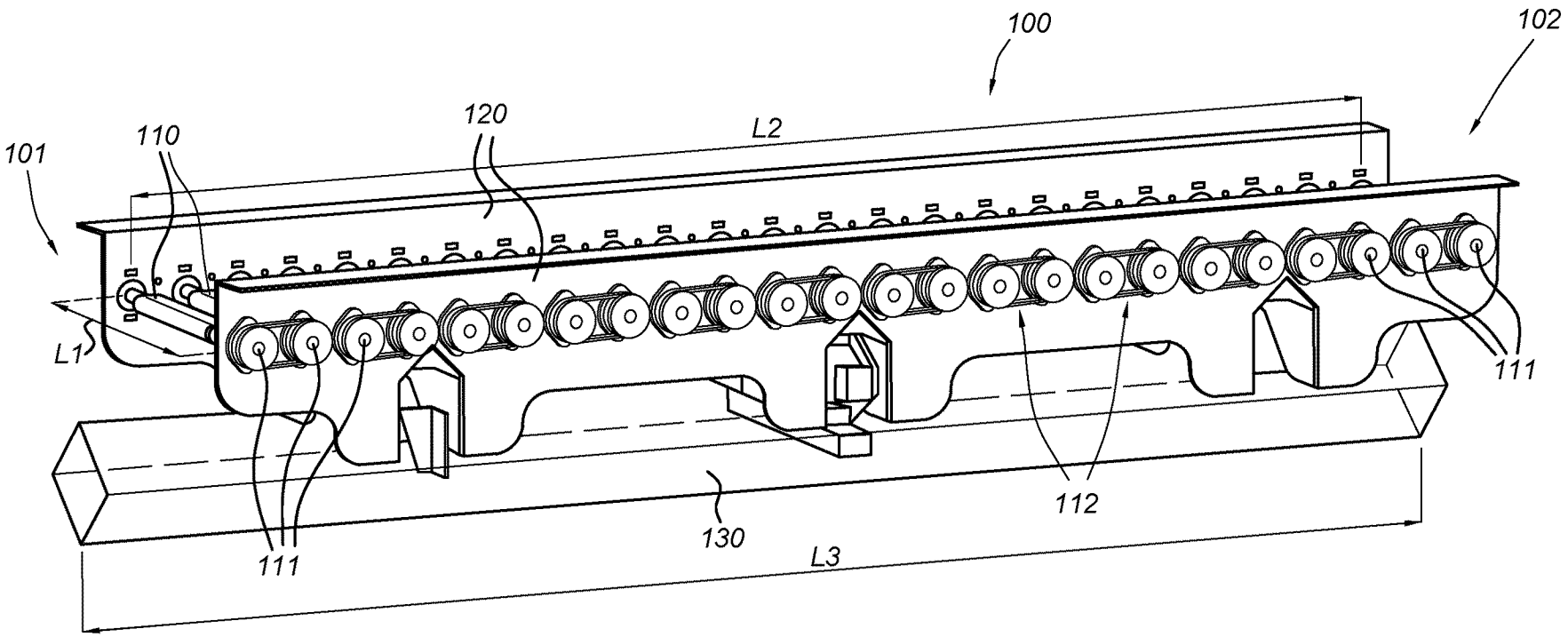
FIG. 9 shows another embodiment of the compactor device according to the invention with a damper mass.

The compactor roller bars 110 of the plurality of compactor roller bars are with their respective axes mounted in the frame 120. In operation, when compacting a product filling within a packing box by rotating the compactor roller bars at a desired rotation frequency, the compactor device together with the packing box(es) forms a primary mass-spring system. This primary mass-spring system presents an eigenfrequency, for instance, of about 9 Hz, at which the system, in operation, shows a very dominant frequency in the frequency spectrum. The embodiment of the compactor device shown in FIG. 9 comprises a damper mass 130 mounted on the frame by mounting elements having spring characteristics, which presents a secondary mass-spring system. The secondary-mass spring system is tuned such that, in operation of the compactor device, energy is transferred from the primary mass-spring system to the secondary mass-spring system. This can be done by one or both of selecting the mass of the damper mass 130 and the spring constant of the spring characteristics of the mounting elements. In the embodiment shown the damper mass 130 is suspended from the frame using rubber dampers (not shown) that have appropriate spring characteristics. As a result energy is transferred to the damper mass 130 and not to the frame with a carefully tuned secondary mass-spring system. Generally, the compactor system with carefully tuned secondary mass-spring system will present two peaks in the frequency spectrum at either side of the eigenfrequency of the compactor device without damper mass, which peaks are much less dominant than the eigenfrequency peak in the frequency spectrum of the compactor device without damper mass.

The damper mass 130 is mounted centrally below the plurality of compactor roller bars with respect to the length L1 of the compactor roller bars 110, as seen in their longitudinal direction. The damper mass is also mounted centrally with respect to a length L2 of the plurality of compactor roller bars, as seen in a direction along the plurality of compactor roller bars in a direction perpendicular to the longitudinal direction of the individual compactor roller bars. In the embodiment shown, the length L3 of the damper mass 130 corresponds to the length L2 of the plurality of compactor roller bars. Corresponding is intended to mean that the lengths L3 and L2 are substantially the same.

The invention claimed is:

1. A compactor device (100) for compacting a product filling, like vented bags containing loose products, in a container (C), like a packing box, the compactor device comprising a container support configured to allow shaking and/or vibrating the container when supported on the container support, wherein the container support comprises a plurality of compactor roller bars (110) arranged to support the container, each compactor roller bar having a rotation axis (111) and a circumferential surface (115) along the rotation axis to allow moving the container with a product filling supported on the plurality of compactor rollers bars up and down at a selected frequency when, in operation, rotating the compactor roller bars of the plurality of compactor roller bars, wherein the compactor roller bars (110) of the plurality of compactor roller bars are arranged parallel to one another in a direction transverse to a conveying direction of the container from a supply end (101) to a discharge end (102) of the compactor device to allow conveying the container in the conveying direction on the compactor device;

a stopper arrangement configured and arranged to block conveying the container by the compactor roller bars (110) of the plurality of compactor roller bars while, in operation, compacting the product filling by rotating the compactor roller bars of the plurality of compactor roller bars; and a pressing arrangement (140) with a pressing element (145) configured and arranged to press downwards directly onto the product filling within the container (C) supported on the plurality of compactor roller bars (110) while, in operation, compacting the product filling by rotating the compactor roller bars of the plurality of compactor roller bars.

2. The compactor device according to claim 1, wherein the compactor device further comprises confining walls configured and arranged to confine opposing sides of the container while, in operation, compacting the product filling by rotating the compactor roller bars of the plurality of compactor roller bars and pressing onto the product filling by the pressing arrangement.

3. The compactor device according to claim 2, wherein the confining walls comprise opposing guiding walls (160) arranged along the conveying direction to guide the container there between when being conveyed over the compactor device.

4. The compactor device according to claim 1, wherein the stopper arrangement comprises at least one stopper door (170) that can be positioned in front of the container as seen in the conveying direction.

5. The compactor device according to claim 1, wherein the circumferential surface of each compactor roller bar presents line symmetry with respect to the rotation axis and an equal cross-sectional shape, perpendicular to the rotation axis, with equal dimensions along the rotation axis, which cross-sectional shape is different from a circular shape.

6. The compactor device according to claim 1, wherein the compactor device is configured to directly support the container on the plurality of compactor roller bars.

7. The compactor device according to claim 1, wherein the pressing arrangement (140) is configured to provide a predetermined downward force by the pressing element (145) onto the product filling in the container while, in operation, compacting the product filling by rotating the compactor roller bars (110) of the plurality of compactor roller bars and pressing onto the product filling by the pressing arrangement.

8. The compactor device according to claim 1, wherein the pressing element (145) is configured as a mass and the pressing arrangement (140) is configured to have a weight of the mass fully supported by the product filling in the container while, in operation, compacting the product filling by rotating the compactor roller bars (110) of the plurality of compactor roller bars and pressing onto the product filling by the pressing arrangement.

9. The compactor device according to claim 1, wherein the pressing arrangement (140) comprises an actuator (146) arranged to allow moving the pressing element (145) up and down.

10. The compactor device according to claim 1, wherein the pressing arrangement (140) comprises more than one pressing element (145) arranged along the conveying direction for compacting product fillings in respective consecutive containers.

11. The compactor device according to claim 10, wherein each pressing element (145) is coupled to a respective actuator to allow moving the pressing elements up and down independently from one another.

12. The compactor device according to claim 1, wherein the compactor roller bars (110) of the plurality of compactor roller bars are configured to each present a same circumferential surface (115) with an equal cross-sectional shape, perpendicular to the rotation axis, with equal dimensions along their respective rotation axes (111).

13. The compactor device according to claim 1, wherein the compactor roller bars (110) of the plurality of compactor roller bars are arranged to provide synchronous rotation.

14. The compactor device according to claim 1, wherein the circumferential surface (115) is a smooth continuous surface.

15. The compactor device according to claim 1, wherein the circumferential surface (115) comprises convex rounded surface sections (115*a*) along the rotation axis, which are connected to one another by flat surface sections (115*b*) along the rotation axis.

16. The compactor device according to claim 15, wherein the convex rounded surface sections (115*a*) conform to constituting parts of a virtual circular cylinder surface (V) around the rotation axis (111) but are each shifted in an outward direction with respect to the respective part of the virtual circular cylinder surface.

17. The compactor device according to claim 16, wherein the circumferential surface (115) comprises two or four convex rounded surface sections (115*a*).

18. The compactor device according to claim 17, wherein the circumferential surface (115) comprises two convex rounded surface sections (115*a*), each convex rounded surface section corresponding to a half part of the virtual circular cylinder surface (V) having a diameter between 20 mm and 50 mm, and a cross-sectional width to cross-sectional thickness ratio being between 1.2 and 2, and the compactor device is configured to drive the compactor roller bars at a rotational speed between 200 rpm and 1,000 rpm.

19. The compactor device according to claim 1, wherein a cross-sectional shape, perpendicular to the rotation axis, of the circumferential surface (115) presents an oval shape (115*c*).

20. The compactor device according to claim 1, wherein the compactor device comprises a frame (120) in which the plurality of compactor roller bars (110) are mounted, which forms, in operation when compacting a product filling in a container (C) by rotating the compactor roller bars of the plurality of compactor roller bars, a primary mass-spring system, and the compactor device comprises a damper mass (130) mounted on the frame by mounting elements having spring characteristics such as to form a secondary mass-spring system.

21. The compactor device according to claim 20, wherein the secondary mass-spring system is tuned to the primary mass-spring system such as to allow energy transfer from the primary mass-spring system to the secondary mass-spring system.

22. The compactor device according to claim 20, wherein the damper mass (130) is mounted below the plurality of compactor roller bars (110) in a central position with respect to a length (L1) of the compactor roller bars of the plurality of compactor roller bars as seen in a longitudinal direction of each compactor roller bar and a length (L2) of the plurality of compactor roller bars as seen in a direction perpendicular to the longitudinal direction of each compactor roller bar.

23. A conveyer system (1) comprising a compactor device according to claim 1.

24. A compacting method for compacting a product filling in a container (C), the method comprising providing at least one container having a product filling comprising loose products, like vented bags containing loose products, and with its top side open onto a compactor device according to claim 1;

compacting the product filling by operating the compacting device, the pressing element of the pressing arrangement acting on the product filling through the open top side of the container; and discharging the container with a compacted product filling from the compactor device or the conveyor system.

25. A packing method for packing a product filling in a container (C), the method comprising providing a product filling comprising loose products, like vented bags containing loose products, into at least one container;

providing the at least one container having a product filling and with its top side open onto a compactor device according to claim 1;

compacting the product filling by operating the compacting device, the pressing element of the pressing arrangement acting on the product filling through the open top side of the container;

discharging the container with a compacted product filling from the compactor device or the conveyor system; and closing the top side of the at least one container.

26. The packing method according to claim 25, wherein the step of providing a product filling into at least one container comprises providing loose products in vented enclosures, and subsequently providing more than one vented enclosure in a single container.

* * * * *